US005086645A

United States Patent [19]

Deaton

[11] Patent Number: 5,086,645

[45] Date of Patent: Feb. 11, 1992

[54] MULTIPLE CALIPER ARMS CAPABLE OF INDEPENDENT MOVEMENT

[75] Inventor: John G. Deaton, Houston, Tex.

[73] Assignee: Halliburton Logging Services, Inc., Houston, Tex.

[21] Appl. No.: 507,285

[22] Filed: Apr. 10, 1990

[51] Int. Cl.[5] ..... G01V 1/00

[52] U.S. Cl. ..... 73/151; 73/634; 73/866.5; 417/226

[58] Field of Search ..... 73/151, 634, 637, 865.8, 73/866.5; 417/226; 92/61, 140

[56] References Cited

U.S. PATENT DOCUMENTS

| | | | |
|---|---|---|---|
| 3,662,172 | 5/1972 | Youmans | 73/151 |
| 3,798,966 | 3/1974 | Planche | 73/151 |
| 4,342,225 | 8/1982 | Jandera et al. | 73/865.8 |
| 4,407,157 | 10/1983 | Lichtenberg | 73/151 |
| 4,468,959 | 9/1984 | Roberts | 73/865.8 |
| 4,711,303 | 12/1987 | Koeling et al. | 73/151 |
| 4,790,381 | 12/1988 | Armell | 73/151 |
| 4,843,896 | 7/1989 | Napeloni et al. | 73/866.5 |
| 4,845,982 | 7/1989 | Gilbert | 73/151 |
| 4,852,069 | 7/1989 | Clerke et al. | 73/151 |
| 4,953,412 | 9/1990 | Rosenberg et al. | 73/866.5 |

FOREIGN PATENT DOCUMENTS

| | | | |
|---|---|---|---|
| 1317112 | 6/1987 | U.S.S.R. | 73/151 |

*Primary Examiner*—Hezron E. Williams
*Assistant Examiner*—Craig Miller
*Attorney, Agent, or Firm*—William J. Beard

[57] ABSTRACT

A multiple arm caliper system for operation of a multiple arm caliper tool is set forth. It incorporates an elongate tool body having a motor means therein. The motor means operates a coupling rod connected to a resilient spring loading a piston within a cylinder. Within the cylinder, and extending through a transverse head defining the cylinder, individual push rods for each caliper arm extend. The push rods are forced from the chamber by fluid pressure within the chamber. Each push rod connects through suitable pivot points to an independent bell crank which is pivotally mounted to rotate each arm. Fluid pressure within the chamber is provided by the motor operating through a push rod which couples through a coil spring in the preferred embodiment to the chamber.

18 Claims, 1 Drawing Sheet

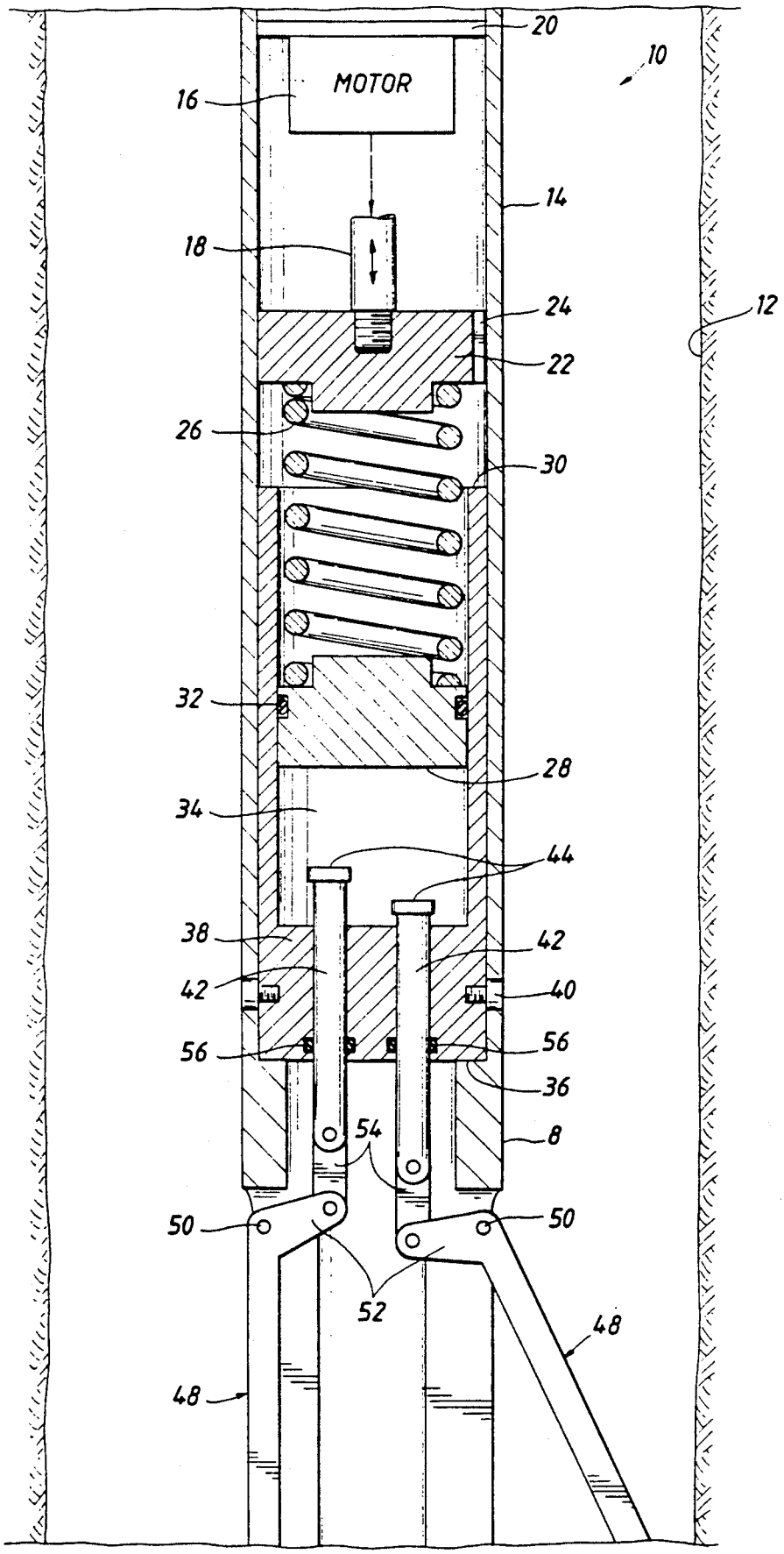
MOTOR
20
10
16
14
18
24
12
22
26
30
32
28
34
44
38
42
42
40
56
56
36
54
8
50
50
52
48
48

MULTIPLE CALIPER ARMS CAPABLE OF INDEPENDENT MOVEMENT

BACKGROUND OF THE DISCLOSURE

There are numerous measuring tools equipped with multiple caliper arms which deflect outwardly from a tool body. There are other downhole logging devices which use extendable arms which move independently of one another to position sensors in contact with the side wall of the well borehole which confines such a tool during use. In general terms, the arms must be forced outwardly so that they contact with certainty against the surrounding wall of the borehole to assure that correct and proper measurements are obtained thereby. Ordinarily, the total number of arms is at least two, typically four. It is difficult to mount four arms for pivotal movement. Each arm must have an associated individual spring which provides the loading force applied to the arm to cause rotation. The four arms thus require four springs, and it is difficult to locate four similar springs all within the common body of the caliper tool housing. The housing may be relatively slim, measuring only two to four inches in diameter. This physical constraint makes it difficult to position all the requiste springs in the housing for operation.

The present disclosure sets out a common or single spring system enhanced with a hydraulic coupling system so that each of the deflected arms is driven in similar fashion so that a common force is applied to all arms. The present apparatus thus operates two or more caliper arms which are pivotally mounted on bell cranks with associated push rods. The push rods extend into a hydraulically closed chamber. Each rod serves as a piston. The chamber is filled with hydraulic fluid which is delivered under pressure. As that pressure is increased, the force acting on each push rod is likewise increased. Pressure to the chamber is controllably applied by an external coupling rod which couples to the chamber through a coil spring. The coil spring defines a force which is also applied to the chamber. The chamber is thus loaded to a specified pressure within the chamber and acts on all the push rods within the chamber. This causes the arm to open and permits each rod to move freely and independently during deflection. This utilizes a single spring which reduces the complexity of packaging multiple parallel springs within the housing subject to space limitations. This further makes the chores of assembly and replacement much easier. The latter is especially important when the caliper arms have to be changed to accommodate different dimension wells. Moreover, the hydraulic system set forth herein is substantially free of expensive hydraulic pumps, valves and associated apparatus and thus is a relatively inexpensive tool.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

The single drawing is a sectional view through a multi-arm caliper measuring device equipped with the single spring system for actuation thereof and further showing a hydraulic system to thereby extend the caliper arms.

DETAILED DESCRIPTION OF THE PREFERRED EMBODIMENT

Attention is directed to FIG. 1 of the drawings where the numeral 10 identifies a caliper arm tool in accordance with the present disclosure. This is intended for caliper measuring devices or other logging tools which have multiple independent arms which extend outwardly from the tool. The device is shown with two arms arranged at 180° opposite one another. As will be understood, it can be constructed with three or four arms which function in the same fashion. If there are four arms, they are preferably arranged to extend radially at 90° angles around the circle. Suffice it to say, the four arms replicate the structure shown for the two arms and in that sense, operate in the same fashion. They differ primarily in the relative angular position of the four arms.

The tool is raised on a logging cable (not shown) which includes one or more conductors. The conductors provide signals to the surface indicative of the position of the caliper arms. This data is readily converted into an electrical signal and sent to the surface to provide at the surface a signal indicative of the caliper of the borehole. The well 12 is typically an uncased well which is being logged so that diameter can be determined. The diameter is determined by moving the tool upwardly on the logging cable. Typically, the position of the caliper tool 10 as a function of depth in the well is also logged. That is, utilizing a recorder which records the position of the caliper tool 10 in the well borehole, the data output by the device is recorded as a function of depth.

The caliper tool 10 is constructed with a sealed internal chamber within a sonde 14. This is constructed with a sealed chamber enclosing the working components. One of the devices within the chamber is a motor 16. The motor 16 provides linear motion to a coupling rod 18. Typically, the motor rotates a gear head connected to a ball screw mechanism to provide linear motion. The motor is any suitable electrical or hydraulic device. The rod 18 is forced downwardly by operation of the motor. The motor is mounted on a transverse bulkhead 20 for support. The motor driven coupling rod connects with a transverse piston 22 which is moved within the cylindrical body 14. To avoid trapping fluid on one side of the piston, there is a port 24 which provides leakage between the two sides so that the piston 22 is located at a neutral pressure.

The piston 22 includes a nether face which is seated against a coil spring 26. The spring 26 bears downwardly against another piston 28. The piston 28 is sealed within a sleeve 30 defining a chamber. The sleeve 30 seals against the piston 28 and leakage between the two is prevented by an O-ring 32. This defines a closed chamber 34 which is located below the piston and within the sleeve at a confined chamber area. The sleeve 30 is received within the sonde housing and abuts against a shoulder 36. In turn, the sleeve 30 includes a transverse head 38 which closes the lower end of the chamber. The chamber is anchored at the shoulder 36 by means of suitable fasteners 40. The chamber is drilled with multiple passages to receive push rods 42 equipped with enlargements at 44. The enlargements 44 prevent the push rods from pushing entirely through the matching drilled openings through the transverse head 38. The enlargements are included to prevent escape. The push rods 42 are sealed against the transverse head 38 and leakage between the two is prevented by an O-ring 56.

The chamber 34 is a pressure isolated chamber. The push rods 42 extend out of this chamber into a region of the tool which is exposed to well pressure. This surrounding well pressure acts against the rods 42. The rods are forced upwardly by the arms as viewed in the only drawing. The rods are forced downwardly when the pressure in the chamber 34 becomes greater than surrounding or ambient pressure. This is important to operation of the device for reasons to be set forth.

The sonde continues withthe cylindrical housing which has a port or window cut for each caliper arm. Each individual arm is identified by the numeral 48 and the arms are pivotally mounted by pivots at 50. The pivots 50 support the arms so that a protruding lever or bell crank 52 extends toward the central portions of the elongate tool housing through the slots provided for the respective arms 48. The bell cranks are connected through connective links 54 to the push rods 42 previously identified. All of these connections are through appropriate pivots.

CALIPER ARM MOTION

An individual caliper arm moves in the following fashion. The arm shown on the left side of the only drawing has been retracted. This results in rotational motion of the bell crank 52 and causes the push rod 42 to move upwardly. It extends farther into the chamber 34 as a result of this motion. By contrast, the arm 48 shown to the right has been extended. It extends to the right as a result of downward movement of the push rod 42. That rod has been forced substantially from the chamber 34. Further, the push rod 42 transfer its downward motion through the link 54 and through the interconnecting pivots so that the arm 48 is rotated outwardly. Substantial torque must be applied to the arm and hence the force acting on the push rod is relatively large. Generally, it is desirable that all arms be deflected outwardly. To this end, the pressure in the chamber 34 is raised substantially. That pressure is raised by operation of the power means 16. When the power means 16 forces the rod 18 downwardly, the force acting on that rod is transferred through the coil spring 26 to the chamber 34. As that force is increased, the force acting on the chamber 34 increases to thereby raise the pressure within the chamber. Pressure within the chamber 34 acts on all the push rods which are exposed within the chamber. Assuming that this pressure exceeds the ambient or surrounding pressure in the well borehole, then the push rods 42 are forced downwardly and the arms are rotated outwardly. This is the customary mode of operation. The coil spring 26 transmits the force applied at the upper end to the lower end. The coil spring will tend to compress as the force is increased. As this compression increases, the hydraulic pressure within the chamber likewise increases.

Assume, for purposes of description, that one of the arms moves more freely than the others, and that one of the arms is retarded. The hydraulic pressure within the chamber 34 is increased as a result of the force applied thereabove and causes all the push rods to move downwardly until opposition is encountered by one or more of the arms. This increases the pressure within the chamber because the connected push rod 42 is no longer free to move. In that event, the increased pressure in the chamber is an increase for all of the push rods because they are exposed to a common pressure. It is preferable to manufacture all the push rods 42 with a common diameter. This common diameter assures that equal forces are applied to all the rods. Yet, the rods do not escape because in the event that one arm is permitted to rotate significantly, the push rod connected to it will move downwardly, but is limited in travel by the surrounding lip or shoulder at the upper end of the push rod.

In operation, should the device of the present apparatus encounter irregularities in the wall of the well borehole, and angular deflection is noted first in one arm and then another arm, the push rods will reciprocate into the chamber 34. This may cause the piston 28 to move slightly. However, it will not move very much in view of the fact that the push rods 42 are relatively small in diameter (hence, small in displacement) compared to the volume of the chamber 34. This kind of coupling system enables the several caliper arms to move independently and yet they are exposed to common forces acting on the respective push rods indicative of a common rotative torque applied to the respective caliper arms.

The output from the several caliper arms is obtained as a result of rotation of the caliper arms. They are connected to position indicators (not shown) which form signals which are provided on respective electrical conductors extending from the caliper tool 10 along the logging cable up to the surface where the data can be recorded as a function of depth in the well borehole. The well 12 is thus gauged by the caliper device of present disclosure and the output data is thus delivered to the surface.

Service of the present apparatus is easily achieved. Should it be necessary, the coil spring 26 can be switched so that a different size spring can be placed in the tool. This will change the mode of operation assuming that a different spring constant is used with the substitute spring. It may be necessary to periodically service the tool by refilling the chamber 34 with clean hydraulic oil. It is isolated from the exterior so that ambient fluid within the well does not intrude into the chamber 34. Moreover, its mode of operations means that it is not operationally affected by changes in ambient pressure. The arms are not wholly independent; rather, they are subject to a common pressure and yet can move independently. Thus, it will operate in the same fashion at a shallow depth as well as a great depth underneath a very substantial head of well fluids standing in the well borehole.

While the foregoing is directed to the preferred embodiments, the scope thereof is determined by the claims which follow.

What is claimed is:

1. A multiple arm caliper tool system for use in a well borehole, comprising:

(a) an elongate tool body that adapted to be lowered and retrieved along a well borehole;

(b) at least a pair of caliper arms, each of said arms being (1) pivotally mounted, (2) for radial extension radially outwardly from the tool body to extend arm tips outwardly for tip engagement with the surrounding well borehole wall, (3) wherein the arm moves radially outwardly on extension to make measurement of the wall borehole by contact of the caliper arm tip, (4) connecting with a push rod for each caliper arm, and (5) wherein said push rods collectively extend into a closed chamber;

(c) a piston isolating said chamber; and (d) means for compressing the hydraulic fluid within said chamber so that hydraulic fluid in said chamber is brought to a specified pressure wherein the hydraulic fluid acts on all of the push rods extending into said chamber.

2. The apparatus of claim 1 wherein said push rods are parallel to one another and extend through a transverse closure wall isolating said chamber and said chamber further includes seal means preventing fluid leakage between said chamber and the well borehole.

3. The apparatus of claim 1 wherein said chamber is closed and sealed by a transverse piston, and said piston is controllably moved by resilient means acting thereagainst.

4. The apparatus of claim 1 wherein chamber is closed and sealed by said piston, and said piston is controllably moved by motor means acting thereagainst.

5. The apparatus of claim 1 wherein said chamber is closed and sealed by a transverse piston, and said piston is controllably moved by motorized resilient means acting thereagainst.

6. The apparatus of claim 5 wherein said piston is moved by a coil spring bearing thereagainst.

7. The apparatus of claim 6 wherein said coil spring is forced by a motor driven rod against said piston.

8. The structure of claim 1 wherein each of said push rods terminates with an enlargement affixed to the end thereof to prevent said push rods from escaping said chamber.

9. The apparatus of claim 8 wherein each of said push rods is pivotally connected to an arm.

10. The apparatus of claim 1 wherein each of said arms includes:

(a) a pivot anchored on said tool body;

(b) a protruding bell crank pivotally mounted by said pivot; and (c) connective means extending from said bell crank to a dedicated push rod for said arm wherein said push rod is adapted to move and thereby rotate said arm.

11. A multiple arm caliper tool system for use in a well borehole, comprising:

(a) an elongate tool body that adapted to be lowered and retrieved along a well borehole;

(b) at least a pair of caliper arms, each of said arms being (1) pivotally mounted, (2) for radial extension radially outwardly from the tool body to extend arm tips outwardly for tip engagement with the surrounding well borehole wall, (3) wherein the arm moves radially outwardly on extension to make measurement of the wall borehole by contact of the caliper arm tip, (4) connecting with a push rod for each caliper arm, and (5) wherein said push rods collectively extend into a closed chamber;

(c) a piston extending across said chamber and sealing thereagainst, said piston being controllably moved by a motor means acting thereagainst to move said piston; and (d) wherein said piston moves within said chamber to change hydraulic fluid within said chamber so that all of the caliper arm tips are deflected outwardly toward the surrounding well borehole wall and said tips contact the wall to enable measurement of the well borehole diameter through said caliper arm movement.

12. The apparatus of claim 11 wherein said push rods are parallel to one another and extend through a transverse closure wall isolating said chamber and said chamber further includes seal means preventing fluid leakage between said chamber and the well borehole.

13. The apparatus of claim 11 wherein said chamber is closed and sealed by said transverse piston, and said piston is controllably moved by resilient means acting thereagainst.

14. The apparatus of claim 13 wherein said piston is moved by a coil spring bearing thereagainst.

15. The apparatus of claim 14 wherein said coil spring is forced by a motor driven rod against said piston.

16. The structure of claim 15 wherein each of said push rods terminates with an enlargement affixed to the end thereof to prevent said push rods from escaping said chamber.

17. The apparatus of claim 16 wherein each of said push rods is pivotally connected to an arm.

18. The apparatus of claim 17 wherein each of said arms includes:

(a) a pivot anchored on said tool body;

(b) a protruding bell crank pivotally mounted by said pivot; and (c) connective means extending from said bell crank to a dedicated push rod for said arm wherein said push rod is adapted to move and thereby rotate said arm.

* * * * *